United States Patent [19]

Thettu et al.

[11] 4,063,530

[45] Dec. 20, 1977

[54] IMAGE FIXING

[75] Inventors: Raghulinga Reddy Thettu, Webster; Luke C. Lin, Brighton, both of N.Y.

[73] Assignee: Xerox Corporation, Stamford, Conn.

[21] Appl. No.: 701,446

[22] Filed: June 30, 1976

Related U.S. Application Data

[62] Division of Ser. No. 556,065, March 6, 1975, abandoned.

[51] Int. Cl.[2] ..... B05C 11/00

[52] U.S. Cl. ..... 118/60; 118/202; 432/60

[58] Field of Search ..... 118/60, 70, 103, 204, 118/202; 432/59, 60, 228; 427/428

[56] References Cited

U.S. PATENT DOCUMENTS

| | | | |
|---|---|---|---|
| 3,640,749 | 2/1972 | Lorenz | 427/428 |
| 3,810,776 | 5/1974 | Banks et al. | 432/60 X |
| 3,878,818 | 4/1975 | Thettu et al. | 432/228 X |
| 3,970,038 | 7/1976 | Thettu | 118/60 |

*Primary Examiner*—Dorsey Newton

[57] ABSTRACT

A method and an apparatus for fixing an image formed by a colorant upon an image support body is described. A fluid, binder material contacts a heated transport surface. The heated surface comprises an elastomeric material which is positioned on a tubular body formed of a material having a relatively high coefficient of thermal conductivity. The transport surface advances the heated binder material to a nip formed with an adjacent pressure contact surface which is transported in moving engagement with the heated surface. The binder material at the nip temperature exhibits a viscosity which exceeds the surface energy of the elastomeric transport surface while the surface energy of the support material and the imaged surface is greater than the surface energy of the elastomer. The binder is thus transferred to the imaged surface for fixing the image thereon.

6 Claims, 2 Drawing Figures

Figure 1:
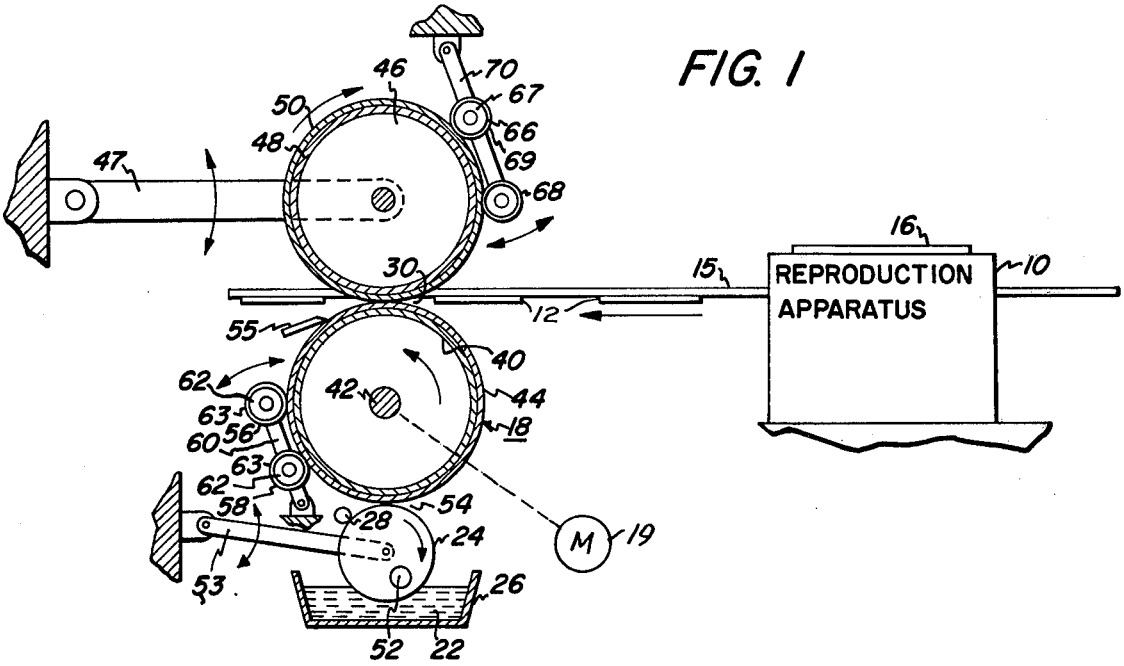

REPRODUCTION APPARATUS
M

IMAGE FIXING

This is a division, of application Ser. No. 556, 065, filed 03/06/75, now abandoned.

This invention relates to a method and an apparatus for fixing images on a support material. The invention relates more particularly to an improved method and apparatus for applying a binder material to an image bearing surface.

In various reproduction systems, an image formed on a support surface is generally fixed to the surface in order to inhibit smudging of the image and to assure its relative permanency. In the xerographic processing arts, for example, an electrostatic latent image is formed on a photoreceptor and is developed by contacting the photoreceptor with a developer material which includes a colorant. The developed image is then transferred to a support sheet for permanent recording. In general, slight contact with the image in this state will cause movement of the toner particles on the support sheet, smudging, and distortion of the image. Therefore, it is customary as a step in the reproduction process to bond or fix the image to the support sheet.

One widely employed technique for effecting this bonding is to provide a particulate toner material which comprises a mixture of a colorant and a resin which can be thermally or solvent softened. As thermal energy or solvent vapor is applied to the toner material in image configuration on the support sheet, the toner softens and tends to become fluid; the contact points between the developed image and the support sheet are broadened; and, the softened toner particles flow together and into the paper fibers. Fixing of the image is also at times enhanced by the simultaneous application of pressure to the support sheet. The softened image then sets upon removal of heat or solvent vapor to provide a relatively permanent image record.

At times it is not feasible to provide a developer material containing a fixing resin because of limitations imposed on the physical characteristics of the materials by the process or by the use of a process which cannot accommodate such a material. In the former case, for example, when the image is formed of pigment particles that are relatively stable with respect to the heat or solvents, then the component used to effect fixing must be introduced after the image is formed. This is also true when fixing resins are employed whose softening temperature or solubility is impractical to employ for the application at hand. An example of a process which provides a pigmented image and which is not generally adapted to accommodate a blend of a heat or vapor softenable resin with the pigment is the photoelectrophoresis process for reproducing images.

The simplest image-forming material is one in which the developer material consists of pure pigments. Typical pigments that have been used to form xerographic images are cadmium yellow, chrome yellow, pulvarized charcoal, and zinc oxide. However, most pigments have no physical property that can be utilized for causing them to adhere to a substrate such as paper. In those situations wherein a mixture of pigment and fixing agent cannot be employed, then fixing of the image has been provided subsequent to the imaging process by applying a fixing vehicle to the entire imaged surface. These techniques include aerosol spraying of the image support body with a clear acrylic; juxtopositioning a polyethylene coated sheet with respect to the support body and applying heat to the sandwich thereby causing the polyethylene to flow to the image support sheet and to fix the image to the support body; and, contacting the image support body with a gelatin capsule coated paper which is initially softened with water.

While these techniques are effective in providing the desired fixing, they do not lend themselves to a continous process for fixing images on a carrier or on a support body such as paper or other plastic film substrate. Furthermore, the pigments exhibit a tendency to stain bodies with which they come into contact. This staining characteristic is undesirable and is believed due to electrostatic particle transfer combined with surface forces associated with moisture and other wetting characteristics. As a result, apparatus components such as transfer rollers are stained and deleteriously affect subsequent images which are formed.

Accordingly, it is an object of this invention to provide an improved method and apparatus for fixing an image formed by a colorant on a support body.

Another object of the invention is to provide an improved method and apparatus for providing continuous fixing of images formed by a colorant.

In accordance with features of the method of this invention, a colorant image is fixed on a support material by heating a binder material to a fluid state, contacting a transport surface at a higher temperature with the binder material, transporting the heated surface and the supported binder material to a nip formed between the binder transport surface and an adjacent pressure contact surface which is transported in moving engagement with the binder transport surface, and transporting a substrate bearing a colorant image through the nip formed by contact beneath the surfaces whereby the binder material is deposited on the image support material and is fixed thereto.

In accordance with features of the apparatus of this invention, an apparatus for fixing an image to a sheet support material comprises a first body having an outer surface thereof, a layer of material formed on said outer surface, means for heating said body to a predetermined temperature, a second body having an outer surface thereof, a layer of material formed on said surface of said second body, said first and second bodies positioned for providing contact between surfaces of said layers at a nip formed therebetween, means for imparting motion to said bodies, and means for applying a binder material to said layer of said first body for transport to said nip whereby a surface of sheet material introduced to said nip is transported therethrough by the motion of said body and a surface thereof adjacent to said surface of said first body is coated with said binder material.

Figure 2:
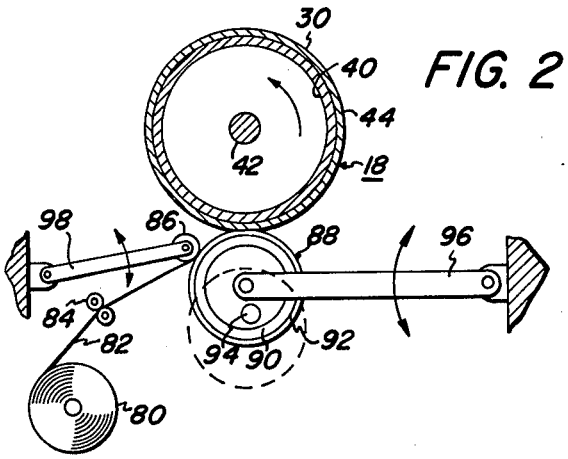

These and other objects and features of the invention will become apparent with reference to the following specification and to the drawings wherein:

FIG. 1 is a schematic diagram illustrating an apparatus for carrying out the present invention; and, FIG. 2 illustrates an alternative binder material applicator for use with the arrangement of FIG. 1.

Referring now to FIG. 1, a reproduction apparatus is illustrated generally as 10. This apparatus comprises a means for forming an image 12 with a colorant on a lower surface 14 of a substrate or support material 15. The support material 15 comprises a web of paper, plastic or other suitable material for receiving the image. Alternatively, the support material may comprise strips or sheets formed of a paper, plastic or other suitable substrate material. The reproduction apparatus 10 comprises, for example, a xerographic copying apparatus which is adapted for forming the colorant image from a document 16. Various xerographic copying apparatus are presently commercially available and provide for the reproduction of the image 12 on the support material 15. One such copier is the 4000 xerographic copier manufactured by the Xerox Corporation of Stamford, Conn. While present day xerographic copiers generally provide a developed image through the use of a developer mix including a toner material consisting of a colorant and a heat fusable resin, as referred to hereinbefore, reproduction with the apparatus 10 of FIG. 1 can be accomplished by utilizing a developer material consisting essentially of a colorant and by disabling fusing means employed with such apparatus.

Alternatively, the apparatus 10 may comprise other forms of reproduction apparatus such as an apparatus which forms the image 12 with photoelectrophoresis techniques. These techniques are discussed in detail in U.S. Pat. Nos. 3,383,993; 3,384,488; 3,384,565 and 3,384,566, the disclosure of which is incorporated herein by reference.

The support body 15 bearing the unfixed visible image 12 is transported to a fixing station at which location the image is bonded to the support body 15 by contacting the surface 14 of the imaged body with a binder material. The fixing station includes a fuser roll 18 which rotates in contact with a pressure roll 20. A liquified binder material 22 for fixing the image 12 to the support body 15 is contained in a heated reservoir 26 and is applied to an outer surface of the fuser roll 18 by an applicator roll 24. The binder material exists in the solid state under ambient conditions, i.e., about 25° C, and transforms to a liquid state when heated to about 86°–104° C. The applicator surface rotates beneath the level of the binder liquid in the reservoir 26 and is thereby coated by the binder. As the applicator roll 24 rotates in a clockwise direction as shown by the arrow, the thickness of the liquid binder material which is carried on its outer surface is made uniform across the width of the surface of the applicator roll by a leveling roll 28 which contacts the binder coated applicator surface. The binder which is coated on the applicator surface is rotated into contact with the outer surface of the fuser roll 18 and the binder material transfers thereto. The binder coated fuser roll 18 transports the binder material to a nip 30 which is formed at a line of contact between the fuser roll 18 and the pressure roll 20. The support body 15 bearing the image 12 is advanced into and through the nip and the binder material 22 thereby coats the support body and fixes the image 12 thereto.

The colorant image 12 which is positioned on the surface 14 of the support sheet can be formed of a variety of materials. When the image 12 is produced by xerographic techniques, the material from which the image is formed generally comprises nonphotosensitive organic or inorganic materials. Typical organic materials comprise carbon black, charcoal, OZITE, available from G.N. Electrical Specialty Co., Blue Island, Ill. and rubber particles. Typical inorganic materials comprise ceramic, glass oxides, synthetic particles such as silicates, zeolites, hydroxides and sulfates.

When the image 12 is formed by photoelectrophoretic techniques, the colorant material comprises a photosensitive inorganic or organic material. Typical inorganic photosensitive compositions include cadmium sulfide, cadmium selenide, cadmium sulfoselenide, zinc oxide, zinc sulfide, sulfur, selenium, antimony sulfide, lead oxide, lead sulfide, arsenic sulfide, arsenic-selenium, and mixtures thereof.

Typical photosensitive organic materials include substituted and unsubstituted organic pigments such as phthalocyanines, for example, copper phthalocyanine, beta form of metal-free phthalocyanine; tetrachlorophthalocyanine; and x-form of metal-free phthalocyanine; quinacridones, as, for example, 2,9-dimethyl quinacridone; 4,11-dimethyl quinacridone; 3,10-dichloro-6-13-dihydroquinacridone; 2,9-dimethoxy-6,13-dihydro-quinacridone and 2,4,9.11-tetrachloroquinacridone; anthraquinones such as 1,5-bis-(beta-phenylethylamino) anthraquinone; 1,5-bis-(3'-methoxypropylamino) anthraquinone; 1,2,5,6-di-(C,C'-diphenyl)-thiazole-anthraquinone; 4-(2'-hydroxyphenyl-methoxyamino) anthraquinone; triazines such as 2,4-diaminotriazine; 2,4-di-(1'-anthraquinonyl-amino-6-(1''-pyrenyl)-triazine; 2,4,6 tri-(1'-1'', 1'''-pyrenyl)-triazine; azo compounds such as 2,4,6-tris (N-ethyl-p-aminophenylazo) phloroglucinol; 1,3,5,7-tetrahydroxy-2,4,6,8-tetra (N-methyl-N-hydroxy-ethyl-p-aminophenylazo) naphthalene; 1,3,5-trihydroxy-2,4,6-tri (3'-nitro-N-methyl-N-hydroxy-methyl-4'-aminophenylazo) benzene; metal salts and lakes of azo dyes such as calcium lake of 6-bromo-1 (1'-sulfo-2-naphthylazo)-2-naphthol; barium salt of 6-cyano-1 (1'-sulfo-2-naphthylazo)-2-naphthol; calcium lake of 1-(2'-azonaphthalene-1'-sulfonic acid)-2-naphthol; calcium lake of 1-(4'-ethyl-5'-chloroazobenzene-2'-sulfonic acid)-2-hydroxy-3-naphthoic acid; and mixtures thereof. Other organic pigments include polyvinylcarbazole; trisodium salt of 2-carboxyl phenyl azo (2-naphthiol-3,6-disulfonic acid; N-isopropyl-carbazole; 3-benzylidene amino-carbazole; 3-amino-carbazole; 1-(4'-methyl-5'chloro-2'-sulfonic acid) azobenzene-2-hydroxy-3-naphthoic acid; N-2'' pyridyl-8,13-dioxodinaphtho-(2,1-b;2',3'-d)-furan-6-carboxamine; 2-amino-5-chloro-p-toluene sulfonic acid and the like.

The binder material 22 is selected to exhibit fixing characteristics for bonding the pigment material to the substrate. Typical bonding materials comprise synthetic polymers including vinyl-type polymers having the characteristic monomeric structure: $>C{=}C<$, and made, for example, from the following vinyl monomers: Esters of saturated alcohols with mono and polybasic unsaturated acids such as alkyl acrylates, methacrylates and haloacrylates, diethyl maleate, and mixtures thereof; vinyl and vinylidene halides such as vinyl chloride, vinyl fluoride, vinylidene chloride, vinylidene fluoride, tetrafluoroethylene, chlorotrifluoroethylene and mixtures thereof; vinyl esters such as vinyl acetate, unsaturated aromatic compounds such as styrene and various alkyl styrenes, alpha-methyl styrene, parachlorostyrene, parabromostyrene, 2,4-dichlorostyrene, vinyl naphthalene, paramethoxystyrene and mixtures thereof; unsaturated amides such as acrylamide, methacrylamide and mixtures thereof; unsaturated nitriles such as acrylonitrile, methacrylonitrile, haloacrylonitrile, phenylacrylonitrile, vinylidene cyanide, and mixtures thereof; N-substituted unsaturated amides such as N,N-di-methyl acrylamide, N-methyl acrylamide and mixtures thereof; conjugated butadienes such as butadiene, isoprene and mixtures thereof; unsaturated ethers such as divinyl ether, diallyl ether, vinyl alkyl ether and mixtures thereof; unsatuated ketones such as divinyl ketone, vinyl alkyl ketone and mixtures thereof; unsaturated aldehydes and acetals such as acrolein and its acetals, methacrolein and its acetals, and mixtures thereof; unsaturated heterocyclic compounds such as vinyl pyridine, vinyl furan, vinyl coumarone, N-vinyl carbazole, and mixtures thereof; unsaturated alicyclic compounds such as vinyl-cyclopentane, vinyl-cyclohexane and mixtures thereof; unsaturated thio compounds such as vinyl thioethers; unsaturated hydrocarbons such as ethylene, propylene, coumarone, indene, terpene, polymerizable hydrocarbon fractions, isobutylene and mixtures thereof; allyl compounds such as allyl alcohol, allyl esters, diallyl phthalate, triallylcyanurate and mixtures thereof; as well as condensation polymers including polyesters, such as linear, unsaturated and alkyd types made, for example, by reacting a difunctional acid or anhydride such as phthalic, isophthalic, terephthalic, malic, maleic, citric, succinic, glutaric, adipic, tartaric, pimelic, suberic, azelaic, sebacic and camphoric with a polyol such as glycerine, ethylene glycol, propylene glycol, sorbitol, mannitol, pentaerythritol, diethylene glycol and polyethylene glycol; polycarbonates such as bisphenol esters of carbonic acid; polyamides such as those made by reacting diamines with dibasic acids where the diamines contain from 2 to 10 carbon atoms and the acids contain from 2 to 18 carbon atoms; polyethers such as the epoxy type made, for example, by condensing epichlorohydrin with any one of disphenol A, resorcinol, hydroquinone, ethylene glycol, glycerol, or other hydroxyl containing compounds; the other polyethers made, for example by reacting formaldehyde with difunctional glycols; polyurethanes prepared, for example, by reacting a diisocyanate such as toluene-2,4-diisocyanate methylene bis (4-phenylisocyanate), bitalylene diisocyanate, 1,5-naphthalene diisocyanate, and hexamethylene diisocyanate with a dihydroxy compound; phenol aldehyde resins made, for example, by condensing resorcinol phenol or cresols with formaldehyde furfural or hexamethylene tetramine; urea formaldehyde; melamine formaldehyde; polythioethers; polysulfonamides; alkyl, aryl and alkaryl silicones, etc.

Any suitable polymeric mixture, copolymer or terpolymer of the above materials may be used in the process of this invention.

Polymers of the types defined above include polyvinyl butyral, copolymers of methacrylic acid with methylmethacrylate, with acrylonitrile or with styrene, copolymers of vinyl acetate with maleic anhydride, copolymers of nitrostyrene with diethylmaleate, copolymers of styrene with acrylic and methacrylic acids and esters, etc. Particular materials comprise copolymers of styrene and Acrylate, polyethylene and polystyrene - PICCOLASTIC resins which are available commercially from the Pennsylvania Industrial Chemical Corporation.

A preferred binder material comprises a copolymer of alkyl acrylates with either pure styrene or a mixture of styrene and styrene homologs of the general formula:

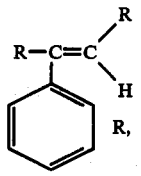

where R is selected from the group consisting of hydrogen and lower alkyl may be used. Such mixtures as these are obtained from fractionation of the so-called "Crude Solvent" from "Light Oils" scrubbed out of coke oven or gas house gas. The styrene or mixture of styrene and styrene homologs should comprise at least about 60% to about 90% of the copolymer composition. The other component of the copolymer may be either n-butyl methacrylate, iso-butyl methacrylate, ethyl methacrylate, propyl methacrylate, isopropyl methacrylate or a mixture thereof. A particularly preferred type of resin within this class is a hard, tough resin prepared by copolymerizing 35% butyl methacrylate and 65% styrene (all parts by weight) and having a melting range of about 86°–104° C, as determined by Fisher-Johns apparatus and being medium high in polymer structure.

Another resin component which can be mixed in minor amount with the copolymer is a long chain thermoplastic plasticizer which has little tendency toward agglomeration or cold flow such as polyvinyl butyral, polyethylene, shellac, waxes, polyesters, polyvinyl acetal, polyvinyl (choride acetate) etc. The resin modifier comprises from about 20% to about 1% based on the total weight of the composition. Preferably it comprises from about 2% to about 10% based on the total weight of the composition.

Typical natural and modified natural resins include rosin, hydrogenated rosin, waxes, gums, fossil resins, protein resins such as zein, asphaltum and others. Illustrative of such resins are those such as described in U.S. Pat. No. 2,659,670 to Copley which describes a resin-modified phenol-formaldehyde resin; U.S. Reissue Pat. No. 25,136 to Carlson which describes a resin of styrene polymers and copolymers and U.S. Pat. No. 3,079,342 to Insalaco, describing a plasticized styrene-methacrylate copolymer resin.

The fuser roll 18 comprises a metal, tubular shaped body 40 which is rotatably mounted and is heated to a temperature $T_1$. This rotating member may be internally heated by a heat source as described in U.S. Pat. No. 3,666,247 or externally heated as described in U.S. Pat. No. 3,498,586 and 3,539,161. In FIG. 1, the body 40 is shown to be heated by an internally positioned quartz lamp 42. The tube 40 is formed of a metal having a relatively high coefficient of thermal conductivity such as copper or aluminum. A layer 44 of material is coated on the outer surface of this tubular body. The layer 44 is formed of a material selected to exhibit several physical relationships with respect to the imaged pigment material, the substrate material 15 and binder material 22. More particularly, the nip 30 has a finite width and, during coating of the substrate 15 within this nip area, the temperature of the binder 22 will decrease from a temperature $T_1$ at the entrance to the nip to an exit temperature $T_e$. This decrease in $\Delta T_n$ can have a magnitude of from about 50° to 100° F. In addition, a temperature gradient exists in the nip across a cross-section formed between the surface 44, the binder 22, the image 12, and the substrate 15. The substrate 15 will therefore be at a relatively lower temperature than the layer 44, the binder 22, and the colored image 12. The layer 44 is formed of a material selected for providing that at the exit temperature $T_e$ at the nip 30, the binder material 22 does not adhere to the surface of the layer 44 but rather adheres to the image substrate surface 14 and the image 12. In providing this characteristic, it is required that the surface energy of the substrate ($\delta_s$) at its exit temperature from the nip be greater than the surface energy of the layer 44 ($\delta_{44}$) at its nip exit temperature, i.e. $\delta_{22\delta 44}$; that, the viscosity of the binder material ($\tau_{22}$) at its exit temperature is greater than the surface energy of the layer 44 at its exit temperature, i.e. $\tau_{22>\delta 44}$; and that the viscosity of the colorant material ($\tau_{12}$) which interfaces with the substrate at its exit temperature is greater than the surface energy of the layer 44 at its exit temperature $\delta_{44}$; i.e. $\tau_{12>\delta 44}$.

Although the material from which the layer 44 is formed should be uniformly wettable by the binder at temperatures higher than the exit temperature $T_e$, i.e. at the temperature $T_1$, it should also preferably exhibit characteristics which enhance separation of the binder material 22 and layer 44 upon exit from the nip. More particularly, the material of layer 44 is preferably formed of a material which can be subjected to a mechanical strain for enhancing release by stretching.

The material of layer 44 preferably also exhibits a relatively high coefficient of thermal expansion and has a thickness selected for producing a temperature drop which permits the binder material 22 upon exit from the nip to decrease to an exit temperature $T_e$ at which temperature the binder viscosity increases and enhances release from the surface.

A material from which the surface 44 is formed and which satisfies these various characteristics comprises an elastomer and in particular a silicone elastomer. Typical silicone elastomers include silicone, fluorosilicone, and flurocarbon such as VITON, which is available from DuPont Corporation, Wilmington, Del. The usual silicone elastomers are prepared from a mixture of dimethyl silicone polymer, an inorganic filler and a vulcanizing agent. The silicone polymer is generally made by polymerization of very pure difunctional silicones in order to obtain a high molecular weight. Heat resistant silicone elastomers such as SILASTIC, which is available from Dow Corning, employ fillers including silica soot. Silicone elastomers generally withstand relatively high temperatures without serious deterioration and have good stability at elevated temperatures. A silicone elastomer exhibits good properties of stretch, retraction, balance and flexibility. They are generally resistant to many chemicals that adversely affect organic elastomers. Fluorosilicone elastomers are advantageously resistant to the hydrocarbon solvents. A fluorosilicone elastomer (SILASTIC which is available from Dow Corning) made from trifluoropropyl methyl dichlorosilane exhibits good hydrocarbon solvent resistance. Particular commercially available elastomeric materials from which the layer 44 can be fabricated include a silicone elastomer manufactured by the General Electric Company and designated as G.E. 112-RTV and a silicone elastomer manufactured by the Dow Corning Company and designated as SYLGARD 184. (SYLGARD is a trademark of the Dow Corning Corporation).

The cylindrically shaped pressure roll which contacts the fuser roll at the nip 30 comprises a solid steel shaft 46 which is covered with a relatively thick layer 48 of an elastomer and which forms the contact or nip zone against the fuser roller when a load is applied thereto. The elastomer comprises, for example, a layer formed of silicone elastomer having a thickness of about 0.375 to 0.500 inch which is covered with a thin layer 50 or sleeve of a fluorocarbon resin such as fluorinated ethylene propylene (FEP) for providing a micro-macro conformability with the surface of the fuser roll 18. This layer has, for example, a thickness of 0.020. The pressure roll is loaded by a conventional loading means such as a spring loading or pneumatic means not shown which exerts a force on the pressure roll. As indicated, the nip 30 has a finite width, $W_n$, in the direction of motion of the rolls. The nip width $W_n$ is established by the characteristics of the surfaces of the fuser and pressure rolls and by the loading force applied therebetween. For the elastomeric materials thus described, a Durometer hardness of 25 to 40 is typically provided and a nip width range of about 0.125 to 0.500 inches is achieved and preferably a width range of about 0.375 to 0.400 inches is provided.

The applicator roll 24 of FIG. 1 comprises a smooth metal roller which is internally heated by a quartz lamp 52. Alternatively, the roll 24 is heated by contact with the surface 44. This roll is heated to temperature $T_2$ at which temperature the binder material 22 wets the entire surface of this roll. As the binder material is applied to the fuser roll surface 44 by the applicator roll 24 at a nip 54 therebetween, the energized heater 42 heats the fuser roll 18 for providing that the temperature $T_1$ of the fuser roll layer 44 along that segment of its course from the nip 54 to the entrance of the nip 30 is greater than the temperature $T_2$ of the applicator roll 24. Similarly, the applicator roll 24 is heated to a temperature for assuring that the applicator roll 24 is maintained at a temperature $T_2$ which is greater than the temperature $T_3$ of the binder material 22 in the reservoir 26. These temperature relationships are provided in order to achieve temperature gradients which allow transfer of the binder material 22 from the reservoir to the applicator roll 24 and from the applicator roll 24 to the fuser roll 18. The binder material 22 tends to wet the hotter surface. Since the temperature $T_3$ of the binder material 22 in the reservoir 26 is less than the temperature $T_2$ of the applicator roll 24, the applicator roll surface will be readily wetted. Similarly, since the temperature $T_2$ of the applicator roll 24 is less than the temperature $T_1$ of the fuser roll 18, the binder material will readily wet and transfer from the applicator roll to the surface 44 of the fuser roll.

Upon wetting at the nip 54, the binder material is transported on the fuser roll surface 44 to the nip 30. While binder materials of the type described hereinbefore will wet and form a uniform fluid layer on the transport surface 44 at the relatively higher temperature $T_1$, e.g. 350° F, it has been found that after an interval of time, $\Theta_1$, the uniform binder layer, will exhibit separation characterized by interruptions in the film. This nonuniformity in the film is disadvantageous for the bonding process herein and is avoided by transporting the binder from the nip 54 to the nip 30 in a time $\Theta_2$ wherein $\Theta_2 < \Theta_1$. The time of transit is established by selection of apparatus parameters including fuser roll diameter, angular velocity, etc.

At the nip 30, the binder is applied to and coats the imaged and nonimaged areas on the surface 14 which is advanced into the nip. As indicated hereinbefore, the exit temperature at the nip 30 is established for providing that the coefficient of surface tension of the binder material is the largest in the system in order to overcome the wetting and elongational sheer forces during separation at the nip. A stripper blade 55 is provided and operates to part the leading edge of the web or of single sheets bearing visible images.

As the fuser roll advances away from the exit nip, the surface of the layer 44 may be covered with residual binder material, colorant, or substrate contamination or combinations of each of these. These residual materials can disadvantageously contaminate a subsequent image which is to be fixed and interfere with the fidelity of reproduction of the images. A fuser roll cleaning means is provided and is located for collecting the residual polymer binder, residual colorant, or substrate contaminants. This cleaning means comprises a pair of rollers 56 and 58 which are rotatably mounted on a pivotally mounted bracket 60. These rollers each comprise a steel tube 62 and an outer jacket 63 of a relatively soft conformable material such as a high temperature nylon or a polyethylene terephthalate such as DACRON. The bracket 60 is adapted to be positioned for causing the rollers 56 and 58 to contact the surface 44 of the fuser roll 18 or to be retracted therefrom. One particular suitable jacket material comprises a high temperature nylon plastic such as NOMEX which is available from DuPont Corporation. Residual particles carried by the layer 44 are contacted by the outer surfaces of the cleaning rolls 56 and 58 in sequence and operate to remove these contaminating residuals from the surface of the layer 44.

Similarly, the surface of the pressure roll 20 is susceptible to adhesion by contaminants between images and a pressure roll cleaning means comprising rolls 66 and 68 is provided. The roll 66 is similar to the rollers 56 and 58 and comprises a steel tube 67 having a soft conformable outer jacket 69 formed of high temperature nylon or DACRON such as NOMEX. The roller 68 comprises a tube of relatively hard aluminum which is rotatably mounted and which includes a segmented outer surface. Contact between this roller and the surface 50 discharges electrostatic charges which tend to adhere particles to this surface. The rollers 66 and 68 are each rotatably mounted on a pivoted bracket 70 which is adapted to be positioned for causing the rollers 66 and 68 to contact the surface 50 of the pressure roll 20 or to be retracted therefrom.

The apparatus of FIG. 1 has a standby and coating modes of operation. During the standby mode, the pressure roll 20, the applicator roll 24, and the cleaning rolls 56 and 58 are retracted from contact with the fuser roll 18. Similarly, the bracket 70 is pivoted away from the pressure roll 20 to interrupt contact between the pressure roll and the rolls 66 and 68. The fuser roll, however, rotates about its stationary longitudinal axis as the reproduction apparatus 10 progresses through a printing operation. Preliminary to advancement of the reproduced image 12 into contact with the fuser roll 18, the pressure roll 20 is advanced into contact therewith to form the nip 30; the applicator roll 24 is brought into contact with a lower surface of the fuser roll 18 to form the nip 54, and the cleaning roll assemblies are brought into contact with the fuser and pressure roll. As the imaged substrate 15 advances into the nip, the binder covered surface 44 will contact the imaged surface 14 and apply the binder material thereto. During the interval between the introduction of subsequent image substrates, the applicator roll 24 and the cleaning rolls 58 and 62 remain in contact with the surface 44 of the fuser roll 18 while the pressure roll 20 and its associated cleaning and discharge rolls 66 and 68 respectively are retracted. The surfaces of the cleaning rolls 58 and 62 thereby remain tacky and pickup paper contaminations from the surface 44.

There is illustrated in FIG. 2 an alternative and preferred embodiment for applying the binder material to the fuser roll 18. Those elements of FIG. 2 which perform functions similar to elements of FIG. 1 bear the same reference numerals. The binder material is supplied to the system in the arrangement of FIG. 2 in web form from a supply roll 80. The web of binder material 82 is guided by rolls 84 to a drive roll 86 and onto the surface of an applicator roll 88. The applicator roll comprises a smooth tubular surface 90 which is covered with a thickness of an elastomer 92 and is heated internally by a quartz lamp 94 or alternatively by contact with the fuser roll 18. The elastomer 92 preferably comprises a sillicone elastomer as described hereinbefore. The applicator roll 88 is heated to a temperature $T_2$ which is greater than the temperature $T_3$ of the web 82 and is less than the temperature $T_1$ of the binder material at the nip 30. The binder material therefore advances between the bodies by virtue of the temperature gradients existing therebetween.

Both the applicator roll 88 and the drive roll 86 are mounted on support brackets 96 and 98 respectively for permitting these rolls to be withdrawn from contact with the fuser roll 18 and the applicator roll 88 respectively during the standby mode. This applicator arrangement is advantageous in that the uniformity of the thin film 82 eliminates the need for a leveling means such as the film leveler 28 which is employed in the arrangment of FIG. 1. In addition, the arrangement of FIG. 2 results in a relatively cleaner fuser surface 44.

There has thus been described an improved method and apparatus for fixing colorant images to a support material. The method and apparatus are advantageous in that they provide for the continuous processing of imaged web or sheet material while inhibiting effects in reproduction resulting from residual contaminating materials.

While we have described particular embodiments of the invention, it will be apparent to those skilled in the art that variations may be made thereto without departing from the spirit of the invention and the scope of the appended claims.

We claim:

1. An apparatus for fixing a visible pigment image to a sheet of support material comprising:

a first heated body having a surface thereof;

a layer of material formed on said surface of said body;

a layer of elastomeric material formed on said surface;

a second body having a surface thereof;

said first and second bodies positioned for providing contact between surfaces of said layers at a nip formed therebetween;

means for imparting motion to said bodies for providing that a sheet of material introduced to said nip between said bodies is transported through said nip;

a source of a binder material for fixing visible image on a sheet;

means for contacting a surface of said elastomeric material with said binder in a fluid state; and means for introducing and transporting through said nip an image support sheet, said support sheet having an image formed thereon by a material consisting essentially of a colorant and wherein an image surface of said support sheet is positioned during transit through said nip for coating said imaged surface with said binder material;

wherein said means for contacting said elastomeric material with said binder comprises a heat applicator body, means for transporting said body in contact with said elastomeric material, and means for contacting said applicator body with said binder material.

2. The apparatus of claim 1 wherein said elastomeric material comprises a silicone elastomer.

3. The apparatus of claim 1 wherein said layer of material formed on the surface of said second body comprises an elastomer overcoated with a fluorocarbon resin.

4. The apparatus of claim 1 including means positioned in contact with said first body for removal of residual contaminant particles from said elastomeric surface as said surface is advanced away from said nip.

5. The apparatus of claim 4 including means for removing residual particles from the surface of said layer of said second body when said surface is advanced away from said nip.

6. An apparatus for fixing a visible pigment image to a sheet to support material comprising:

a first heated body having a surface thereof;

a layer of elastomeric material formed on said surface;

a second body having a surface thereof;

a layer of material formed on said surface of said body;

said first and second bodies positioned for providing contact between surfaces of said layers at a nip formed therebetween;

means for imparting motion of said bodies for providing that a sheet of material introduced to said nip between said bodies is transported through said nip;

a source of a binder material for fixing visible image on a sheet;

means for contacting a surface of said elastomeric material with said binder in a fluid state; and means for introducing and transporting through said nip an image support sheet, said support sheet having an image formed thereon by a material consisting essentially of a colorant and wherein an images surface of said support sheet is positioned during transit through said nip for coating said imaged surface with said binder material;

means positioned to contact with said first body for removal of residual contaminant particles from said elastomeric surface as said surface is advanced away from said nip;

means for discharging an accumulated electrostatic charge on the surface of said layer of said second body.

* * * * *